US006718662B1

(12) United States Patent
Schaff

(10) Patent No.: US 6,718,662 B1
(45) Date of Patent: Apr. 13, 2004

(54) DO-ALL RAKE-TOOTH BUCKET EXTENSION ATTACHMENT

(76) Inventor: Timothy Schaff, P.O. Box 41, Fishtail, MT (US) 59028

( * ) Notice: Subject to any disclaimer, the term of this patent is extended or adjusted under 35 U.S.C. 154(b) by 0 days.

(21) Appl. No.: 10/428,343

(22) Filed: May 1, 2003

Related U.S. Application Data

(60) Provisional application No. 60/378,837, filed on May 6, 2002.

(51) Int. Cl.[7] ..... E02F 3/96

(52) U.S. Cl. ..... 37/405; 172/817; 172/253; 172/252; 171/63; 171/43; 414/912; 414/724

(58) Field of Search ..... 37/405, 403, 444, 37/903; 414/912, 724, 722; 172/245, 247, 250, 252, 253, 817; 171/63, 43, 144

(56) References Cited

U.S. PATENT DOCUMENTS

| | | | | | |
|---|---|---|---|---|---|
| 2,597,374 | A | | 5/1952 | Richey | |
| 2,612,280 | A | * | 9/1952 | Stueland | 414/722 |
| 2,935,802 | A | | 5/1960 | Wolfe et al. | |
| 2,993,608 | A | * | 7/1961 | Womble | 414/717 |
| 3,034,237 | A | | 5/1962 | Wolfe et al. | |
| 3,079,021 | A | * | 2/1963 | Kohorst et al. | 414/725 |
| 3,214,041 | A | | 10/1965 | Walberg | |
| 3,349,933 | A | | 10/1967 | Simpson et al. | |
| 3,362,554 | A | | 1/1968 | Fortier | |
| 3,557,877 | A | * | 1/1971 | Hoffman | 171/63 |
| 3,643,821 | A | | 2/1972 | Viel | |
| 3,706,388 | A | | 12/1972 | Westendorf | |
| 3,795,070 | A | * | 3/1974 | Bronson et al. | 37/405 |
| 3,834,567 | A | | 9/1974 | Miller | |
| 3,967,397 | A | * | 7/1976 | Nault | 37/405 |
| 4,125,952 | A | | 11/1978 | Jennings | |
| 4,411,585 | A | | 10/1983 | Quinn | |
| D361,772 | S | | 8/1995 | Hulsey | |
| 5,515,625 | A | | 5/1996 | Keigley | |
| 5,544,435 | A | * | 8/1996 | Somero | 37/405 |
| 5,564,885 | A | * | 10/1996 | Staben, Jr. | 414/724 |
| 5,664,348 | A | | 9/1997 | Omann | |
| 6,092,606 | A | | 7/2000 | Basler | |
| 6,182,385 | B1 | * | 2/2001 | Knutson | 37/442 |
| 6,209,236 | B1 | | 4/2001 | Omann | |
| 6,360,458 | B2 | * | 3/2002 | Dolister | 37/195 |
| 6,419,028 | B1 | * | 7/2002 | Provitola | 171/1 |
| 6,546,650 | B1 | * | 4/2003 | Meurer | 37/405 |

* cited by examiner

*Primary Examiner*—Victor Batson
(74) *Attorney, Agent, or Firm*—Robert M Hunter

(57) ABSTRACT

An apparatus for attachment to the bucket of a front end loader, skip loader or any other power-operated bucket. The apparatus comprises a plurality of teeth supported in a frame that attaches to the bucket of a front end loader. The apparatus may be used to sort unwanted material, e.g., small and large pieces of wood, rocks and waste products such as manure, from dirt and then to transfer the unwanted material into the bucket of the loader.

22 Claims, 4 Drawing Sheets

DO-ALL RAKE-TOOTH BUCKET EXTENSION ATTACHMENT

CROSS-REFERENCE TO RELATED APPLICATIONS

This application claims the benefit of U.S. Provisional Application No. 60/378,837, filed May 6, 2002, the disclosure of which application is incorporated by reference as if fully set forth herein.

STATEMENT REGARDING FEDERALLY SPONSORED RESEARCH OR DEVELOPMENT

Not Applicable

BACKGROUND OF THE INVENTION

This invention relates to an attachment for the bucket of a front end loader. In particular, the invention relates to a rake-tooth bucket attachment.

The background art is characterized by U.S. Pat. Nos. 2,597,374; 2,935,802; 3,034,237; 3,214,041; 3,349,933; 3,362,554; 3,643,821; 3,706,388; 3,834,567; 4,125,952; 4,411,585; 5,515,625; 5,564,885; 5,664,348; 6,092,606 and 6,209,236; and U.S. Des. Pat. No. 361,772; the disclosures of which patents are incorporated by reference as if fully set forth herein.

Richey in U.S. Pat. No. 2,597,374 discloses a material handling device. This invention is limited in that back and middle transverse members and at least one transverse rod forward of the bucket lip are not provided to support the teeth. Neither do embodiments of the invention incorporate teeth that are pointed on both ends.

Wolfe et al. in U.S. Pat. No. 2,935,802 disclose a multi-function attachments carrier for farm loaders and the like. This invention is limited in that a middle transverse member and at least one transverse rod forward of the bucket lip are not provided to support the teeth. Neither do embodiments of the invention incorporate teeth that are pointed on both ends.

Wolfe et al. in U.S. Pat. No. 3,034,237 disclose another multi-function attachments carrier for farm loaders and the like. This invention is limited in that a middle transverse members and at least one transverse rod forward of the bucket lip are not provided to support the teeth. Neither do embodiments of the invention incorporate teeth that are pointed on both ends.

Walberg in U.S. Pat. No. 3,214,041 discloses a scoop for front end loaders. This invention is limited in that back and middle transverse members and at least one transverse rod forward of the bucket lip are not provided to support the teeth. Neither do embodiments of the invention incorporate teeth that are pointed on both ends.

Simpson et al. in U.S. Pat. No. 3,349,933 disclose a pavement lifter. This invention is limited in that at limited in that a back transverse member and at least one transverse rod substantially forward of a middle transverse member and the bucket lip not provided to support the teeth. Neither do embodiments of the invention incorporate teeth that are pointed on both ends.

Fortier in U.S. Pat. No. 3,362,554 discloses a rear-end hydraulic loader for a tractor. This invention is limited in that back and middle transverse members and at least one transverse rod forward of the bucket lip are not provided to support the teeth. Neither do embodiments of the invention incorporate teeth that are pointed on both ends.

Viel in U.S. Pat. No. 3,643,821 discloses a front loader-type rock picker. This invention is limited in that back and middle transverse members and at least one transverse rod forward of the bucket lip are not provided to support the teeth. Neither do embodiments of the invention incorporate teeth that are pointed on both ends.

Westendorf in U.S. Pat. No. 3,706,388 discloses a fork attachment for a loader bucket. This invention is limited in that at least one transverse rod forward of the bucket lip is not provided to support the teeth. Neither do embodiments of the invention incorporate teeth that are pointed on both ends.

Miller in U.S. Pat. No. 3,834,567 discloses an adapter apparatus for a tractor. This invention is limited in that a back transverse member and at least one transverse rod forward of the bucket lip are not provided to support the teeth. Neither do embodiments of the invention incorporate teeth that are pointed on both ends.

Jennings in U.S. Pat. No. 4,125,952 discloses a bucket attachment. This invention is limited in that at least one transverse rod forward of the bucket lip is not provided to support the teeth. Neither do embodiments of the invention incorporate teeth that are pointed on both ends.

Quinn in U.S. Pat. No. 4,411,585 discloses a fork attachment for loader buckets. This invention is limited in that a middle transverse member and at least one transverse rod forward of the bucket lip are not provided to support the teeth. Neither do embodiments of the invention incorporate teeth that are pointed on both ends.

Keigley in U.S. Pat. No. 5,515,625 discloses a rake attachment with scarifying teeth for a skid loader. This invention is limited in that back and middle transverse members and at least one transverse rod forward of the bucket lip are not provided to support the teeth. Neither do embodiments of the invention incorporate teeth that are pointed on both ends.

Staben, Jr. in U.S. Pat. No. 5,564,885 discloses a multi-purpose work attachment for a front end loader. This invention is limited in that at least one transverse rod forward of the bucket lip is not provided to support the teeth. Neither do embodiments of the invention incorporate teeth that are pointed on both ends.

Omann in U.S. Pat. No. 5,664,348 discloses a rock and material loading apparatus. This invention is limited in that back and middle transverse members and at least one transverse rod forward of the bucket lip are not provided to support the teeth. Neither do embodiments of the invention incorporate teeth that are pointed on both ends.

Basler in U.S. Pat. No. 6,092,606 discloses a stone gathering apparatus. This invention is limited in that at least one transverse rod forward of the bucket lip is not provided to support the teeth. Neither do embodiments of the invention incorporate teeth that are pointed on both ends.

Omann in U.S. Pat. No. 6,209,236 discloses an actuated material loader with open fence. This invention is limited in that back and middle transverse members and at least one transverse rod forward of the bucket lip are not provided to support the teeth. Neither do embodiments of the invention incorporate teeth that are pointed on both ends.

Hulsey in U.S. Pat. No. Des. 361,722 discloses a front end loader attachment for moving rocks. This invention is limited in that at least one transverse rod forward of the bucket lip is not provided to support the teeth. Neither do embodiments of the invention incorporate teeth that are pointed on both ends.

None of the individual references or combination of references teach the invention disclosed herein.

BRIEF SUMMARY OF THE INVENTION

One purpose of the invention is to enable an operator to use a front end loader, skid loader, utility tractor, all terrain vehicle (ATV) or any other power apparatus to sort unwanted material, e.g., small or large pieces of wood, rocks and waste products such as manure, from dirt and then to transfer the unwanted material into the bucket of the loader. Another purpose of the invention is to enable an operator to use a loader to level a work area while collecting unwanted material. Still another purpose of the invention is to provide an attachment for extending the reach of an existing loader and bucket to clean ditches. Another purpose is to loosen the surface of hard ground. Still another purpose is to carry materials with the bucket that would not otherwise be possible, such as round hay bales, trees, poles, etc.

One advantage of the invention is that can be quickly attached to a wide variety of front end loader buckets. Another advantage is that the teeth spacing and extension from the bucket allow the loader to be used for a wide variety of activities. Yet another advantage of the invention is its low cost. Another advantage is that the invention allows the operator better visibility to perform designated work.

In a preferred embodiment, the invention is an apparatus for attachment to the bucket of a front end loader, skip loader or any other power-operated bucket. The apparatus preferably comprises a plurality of teeth supported in a frame that attaches to the bucket of a front end loader. The placement and spacing of the teeth may vary according to dimensions of the material to be sorted. Preferably, the teeth are spaced about one and one half inches to about three and one half inches apart and more preferably about two inches apart. Preferably, the teeth are pointed at about a fifty-five degree angle. In preferred embodiments, the apparatus is fabricated from mild steel by cutting out the parts and welding them together. In other preferred embodiments, the apparatus is fabricated from high abrasive steel or high impact steel. The invention may be marketed as an attachment and/or as a bucket-attachment combination.

In use, a preferred embodiment of the invention is mounted on a bucket by placing the front end of the bucket into the metal pocket formed by the middle transverse member and bolting the member to pre-drilled holes in the lip of the bucket. Then the end brackets are connected with bolts to pre-drilled holes in the sides of the bucket. Preferably, brackets of three alternative types, short bar, long bar and triangle-shaped, are provided to allow attachment of the invention to a wide variety of buckets.

The invention is preferably operated by scooping up a mixture of wanted and unwanted material into the device by shaking the bucket and by tilting the device backward to move the unwanted material along the rakes until it reaches the bucket. The wanted material falls out of the device through the spaces between the rakes. The invention can be used to level an area by orienting the teeth at an angle to the ground and backing the skip loader up while applying downward pressure on the rake. The invention also has utility in ditch work, landscaping (e.g., removing weeds, branches, limbs, trees, grass and sod), cleaning corrals, hauling and distributing gravel on a road surface, leveling a bumpy road and hauling more material than can normally be accommodated in a bucket.

A preferred embodiment of the invention is an attachment for the bucket of a front-end loader, the bucket having a back, a bottom with a forward end (e.g., a lip) having a plurality of transverse attachment holes and sides, each of the sides having at least one bucket mounting hole, the attachment comprising: (1) a rake comprising a plurality of teeth oriented substantially parallel to one another in a row, each of the teeth having a front end, a middle portion and a back end, and each of the teeth at the ends of the row having a rake mounting hole therein; a back transverse member to which the back ends of the teeth are attached; a middle transverse member to which the middle portions of the teeth are attached, the middle transverse member forming a pocket that is configured to receive the forward end of the bucket, the middle transverse member having a plurality of transverse mounting holes therein that align with the transverse attachment holes on the forward end of the bucket for attaching the attachment to the forward end of the bucket by bolting; and at least one transverse rod perforating and supporting the teeth between the points of attachment of the middle transverse member and the front ends; and (2) two end brackets, each of the end brackets having a rake attachment hole at one extremity that aligns with rake mounting hole on one of the end teeth and a bucket attachment hole at a second extremity that aligns with the at least one bucket mounting hole on the bucket for mounting of the rake on the bucket by bolting.

In another preferred embodiment, both the front ends and the back ends of the teeth are pointed. In an alternative embodiment, only the forward ends of the teeth are pointed.

In preferred embodiments, the attachment of the disclosed invention further comprises: a plurality of transverse rods perforating and supporting the teeth between the points of attachment of middle transverse member and the front ends. Preferably, two transverse rods perforate and support the teeth between the points of attachment of the middle transverse member and the front ends.

In yet another preferred embodiment, each of the transverse rods is welded to one of the teeth at each tooth perforation. In another embodiment, each of the transverse rods pass through spacer tubes (e.g., short lengths of pipe) situated between the teeth that act to space the teeth apart. In this embodiment, each of the transverse rods is threaded on both ends to accept bolts that, when tighten, secure the rod in place.

In a preferred embodiment, the attachment of the disclosed invention further comprises: at least one spacer member that is attached to the top surface of the back transverse member to space the top of the back transverse below the bottom of the bucket, thereby orienting the teeth substantially parallel with the bottom of the bucket.

In another preferred embodiment, each bracket is substantially triangular in shape and has a rear-end attachment hole at a third extremity that aligns with a second bucket mounting hole on the bucket for mounting of the rack on the bucket by bolting. Preferably, the pocket is formed by attaching an inclined transverse member to the top edge of a lower transverse member.

In another preferred embodiment, the invention is a front end loader accessory comprising: a bucket; and the attachment disclosed herein.

In another preferred embodiment, the invention is an improved front end loader comprising: the accessory of disclosed herein; and means to manipulate the accessory (e.g., a loader having movable arms at its front end).

In yet another preferred embodiment, the invention is an accessory for a loader, the accessory comprising: (1) a bucket having a back, sides and a bottom with a forward end;

(2) a rake comprising: a plurality of teeth oriented substantially parallel to one another in a row, each of the teeth having a front end, a middle portion and a back end; a back transverse member to which the back ends of the teeth are attached; a middle transverse member to which the middle portions of the teeth are attached, the middle transverse member forming a pocket that is configured to receive the forward end of the bucket and that is attached to the forward end of the bucket; and at least one transverse rod perforating and supporting the teeth between the points of attachment of middle transverse member and the front ends; and (3) two end brackets, each of the end brackets being operative to connect the rake to one of the sides of the bucket. Preferably, both the front ends and the back ends of the teeth are pointed. Preferably, the end brackets connect the two teeth at the ends of the row to the sides of the bucket.

In another preferred embodiment, the invention is an attachment for a power-operated bucket, the bucket having a back, sides and a bottom with a forward end, the attachment comprising: (1) a rake comprising: a plurality of teeth oriented substantially parallel to one another in a row, each of the teeth having a front end, a middle portion and a back end; a back transverse member to which the back ends of the teeth are attached; a middle transverse member to which the middle portions of the teeth are attached, the middle transverse member being attachable to the forward end of the bucket; and at least one transverse rod separating and supporting the teeth between the points of attachment of middle transverse member and the front ends; and (2) two end brackets for mounting of the rake on the bucket. Preferably, both the forward ends and the back ends of the teeth are pointed. Preferably, the attachment further comprises: a plurality of transverse rods perforating and supporting the teeth between the points of attachment of middle transverse member and the front ends and at least one transverse rod supporting the teeth adjacent to the back ends. Preferably, the transverse rods pass through spacer tubes situated between the teeth that act to space the teeth apart. Preferably, the transverse rods are threaded on both ends to accept bolts that, when tighten, secure the rods and the spacer tubes in place.

In another preferred embodiment, the invention is an attachment for facilitating the separation of a first material from a second material with a power-operated bucket on which the attachment is mounted, the bucket having a back, sides and a bottom with a lip, the attachment comprising: (1) a rake comprising: a plurality of teeth oriented substantially in a row, each of the teeth having a front end, a middle portion and a back end; a back transverse member to which the back ends of the teeth are attached; a middle transverse member to which the middle portions of the teeth are attached, the middle transverse member being attachable to the lip of the bucket; and at least one transverse rod separating and supporting the teeth, said at least one transverse rod being spaced substantially forward of the lip of the bucket and being operative to prevent the first material from falling between the teeth and to allow the second material to fall between the teeth when said rake is mounted on said bucket; and (2) end brackets for attaching the rake to the sides of the bucket.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
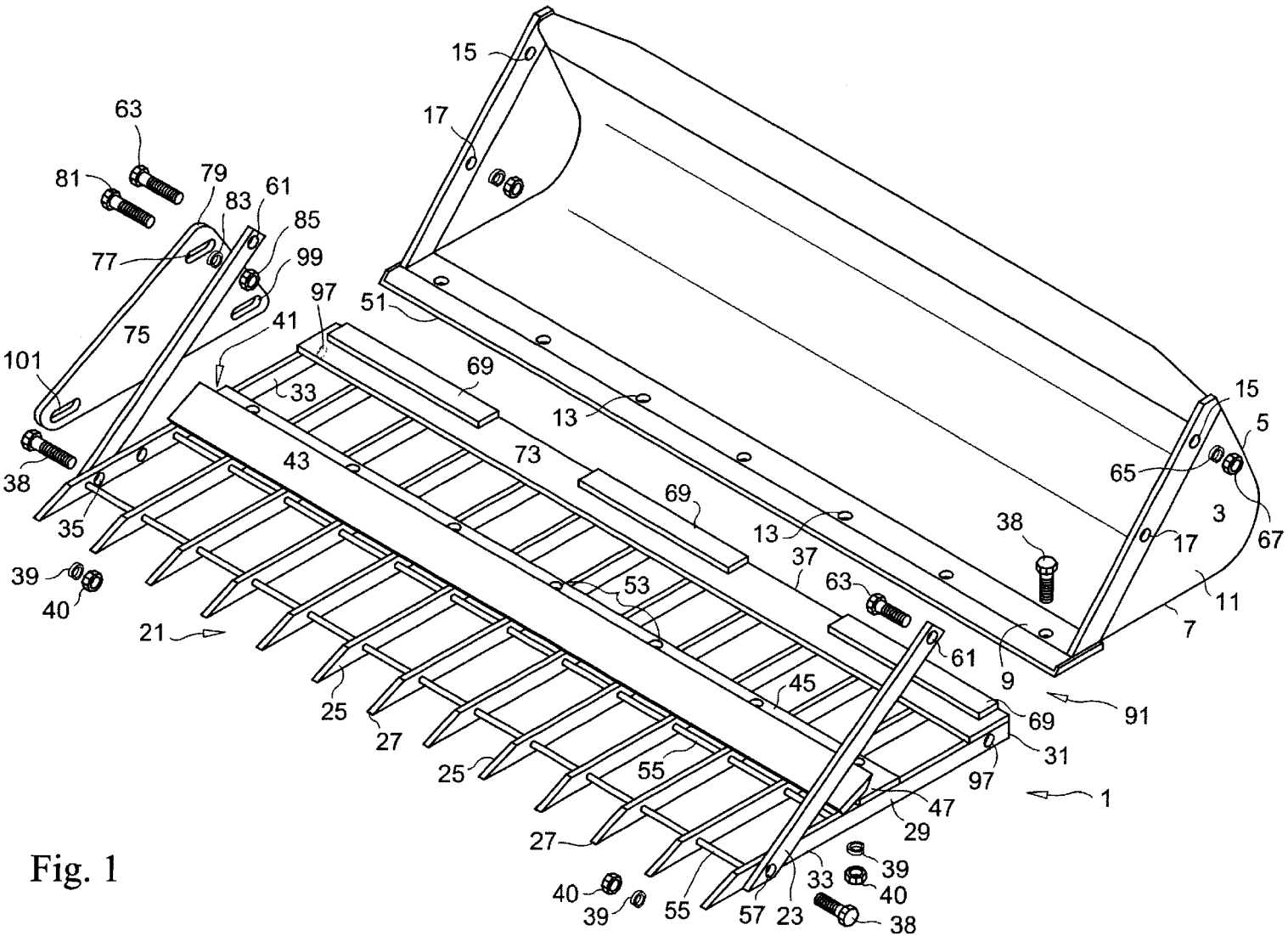
FIG. 1 is an exploded perspective view of a preferred embodiment of the invention.

The following reference numerals are used to indicate the parts and environment of the invention on the drawings:

1 attachment, apparatus, device
3 bucket
5 back
7 bottom
9 forward end
11 sides
13 transverse attachment holes
15 bucket mounting hole
17 second bucket mounting hole
19 bar holes
21 rake
23 first brackets, long bar brackets, end brackets
25 teeth
27 front end
29 middle portion
31 back end
33 end teeth
35 rake mounting hole
37 back transverse member
38 first bolts
39 first lock washers
40 first nuts
41 middle transverse member
43 upper member, inclined transverse member
45 lower member, lower transverse member
47 pocket
51 forward end or lip
53 transverse mounting holes
55 rods, transverse rods
57 rake attachment hole
61 bucket attachment hole
63 second bolt
65 second lock washer
67 second nut
69 spacer member
73 top surface
75 adjustable end brackets, U-shaped brackets
77 rear-end attachment hole or slot
79 extremity
81 third bolts
83 third lock washers
85 third nuts
91 accessory
93 improved front end loader
95 bucket moving apparatus
97 rear hole
99 back-end attachment hole or slot
101 front-end attachment hole or slot
103 spacer tubes
105 flat bars

107 rake attachment holes
139 rod lock washers
140 rod nuts
141 bar lower lock washers
143 bar upper nuts

DETAILED DESCRIPTION OF THE INVENTION

Referring to FIG. 1, a preferred embodiment of the invention is presented. In this embodiment, attachment 1 is attachable to bucket 3 of a front-end loader (not shown). Bucket has back 5, bottom 7 with forward end or lip 9 and sides 11. Preferably forward end 9 is provided with a plurality of transverse attachment holes 13 and each of which sides 11 is provided with bucket mounting hole 15 and may be provided with second bucket mounting hole 17.

Attachment 1 preferably comprises rake 21 and first brackets 23. Rake 21 comprises plurality of teeth 25 oriented substantially parallel to one another in a row. Each of teeth 25 preferably comprises front end 27, middle portion 29 and back end 31. Each of end teeth 33 at the ends of the row are preferably provided with rake mounting hole 35 therein, located adjacent front end 27 of the end tooth.

Rake 21 further comprises back transverse member 37 to which back ends 31 of teeth 25 are attached and middle transverse member 41 to which the middle portions of the teeth are attached. Preferably, middle transverse member 41 comprises (preferably beveled) upper portion 43 and lower portion 45 which form pocket 47 that is configured to receive forward end or lip 51 of bucket 3. Preferably, lower member 45 has transverse mounting holes 53 therein that align with transverse attachment holes 13 in front end or lip 51 of bucket 3 for attaching attachment 1 to forward end or lip 51 of bucket 51 by bolting with first bolts 38 (only one shown for clarity), first lock washers 39 and first nuts 40. Rake 21 further comprises at least one transverse rod 55 that separates and supports teeth 25 (and, in some embodiments, perforates or attaches to teeth 25) between the points of attachment of middle transverse member 43 and front ends 27.

Attachment 1 further comprises two end brackets 23. Each of which end brackets 23 has rake attachment hole 57 at one extremity that aligns with rake mounting hole 35 (adjacent front end 27) on one of the end teeth 33 and bucket attachment hole 61 at a second extremity that aligns with bucket mounting hole 15 on bucket 3 for mounting of attachment 1 on bucket 3 by bolting with second bolt 63, second lock washer 65 and second nut 67.

In a preferred embodiment, attachment 1 further comprises at least one spacer member 69 that is attached to top surface 73 of back transverse member 37 to space the top surface 73 of back transverse member 37 below bottom 7 of bucket 3. This orients teeth 25 substantially parallel with bottom 7 of bucket 3. Preferably, pocket 47 is formed by attaching top portion or inclined transverse member 43 to top edge 87 of lower portion 47 of middle transverse member 41.

In another preferred embodiment, adjustable end bracket 75 is provided. Adjustable end bracket 75 is substantially triangular in shape. Front-end attachment hole or slot 101 aligns with rake mounting hole 35 and back-end attachment hole or slot 99 aligns with rear hole 97 and allows bolting of one adjustable end bracket 75 to each end of rake 21. Rear-end attachment hole or slot 77 at third extremity 79 that aligns with second bucket mounting hole 17 on bucket 3 and allows mounting of attachment 1 on bucket 3 by bolting with third bolts 81, third lock washers 83 and third nuts 85.

In preferred embodiment the attachment 1 further comprises plurality of transverse rods 55 perforating and attached to teeth 25, preferably between the points of attachment of teeth 25 of middle transverse member 41 and pointed ends 27.

In another preferred embodiment, the invention is front end loader 91 accessory comprising bucket 3 and with attachment 1 integrally attached thereto. In this embodiment, accessory 91 is sold as a complete product.

Figure 2:
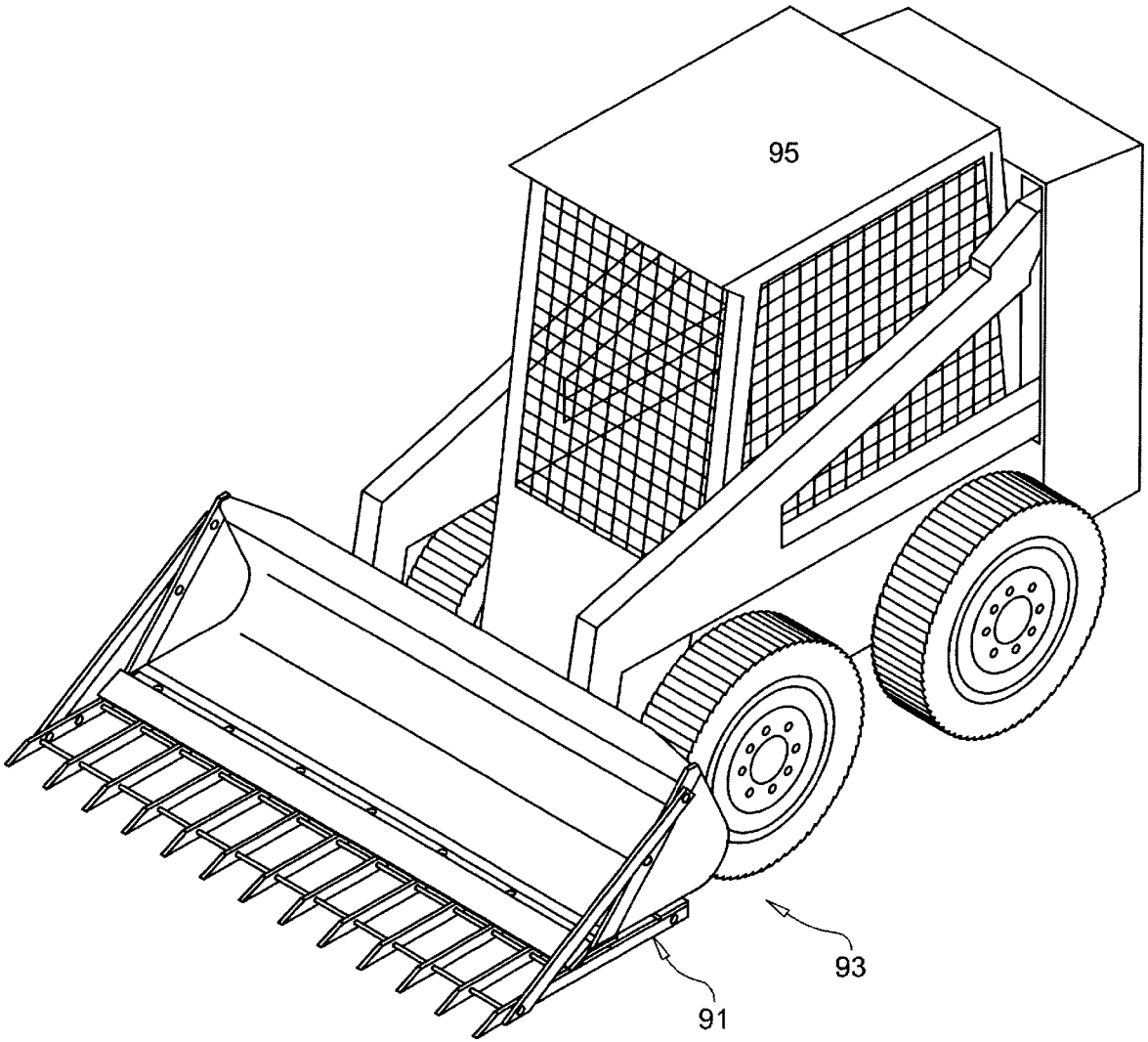
FIG. 2 is another perspective view of a preferred embodiment of the invention.

As illustrated in FIG. 2, in another preferred embodiment, the invention is an improved front end loader. In this embodiment, improved front end loader 91 is sold as a complete product that includes an embodiment of attachment 1, bucket 3 and bucket moving apparatus 95.

Figure 3:
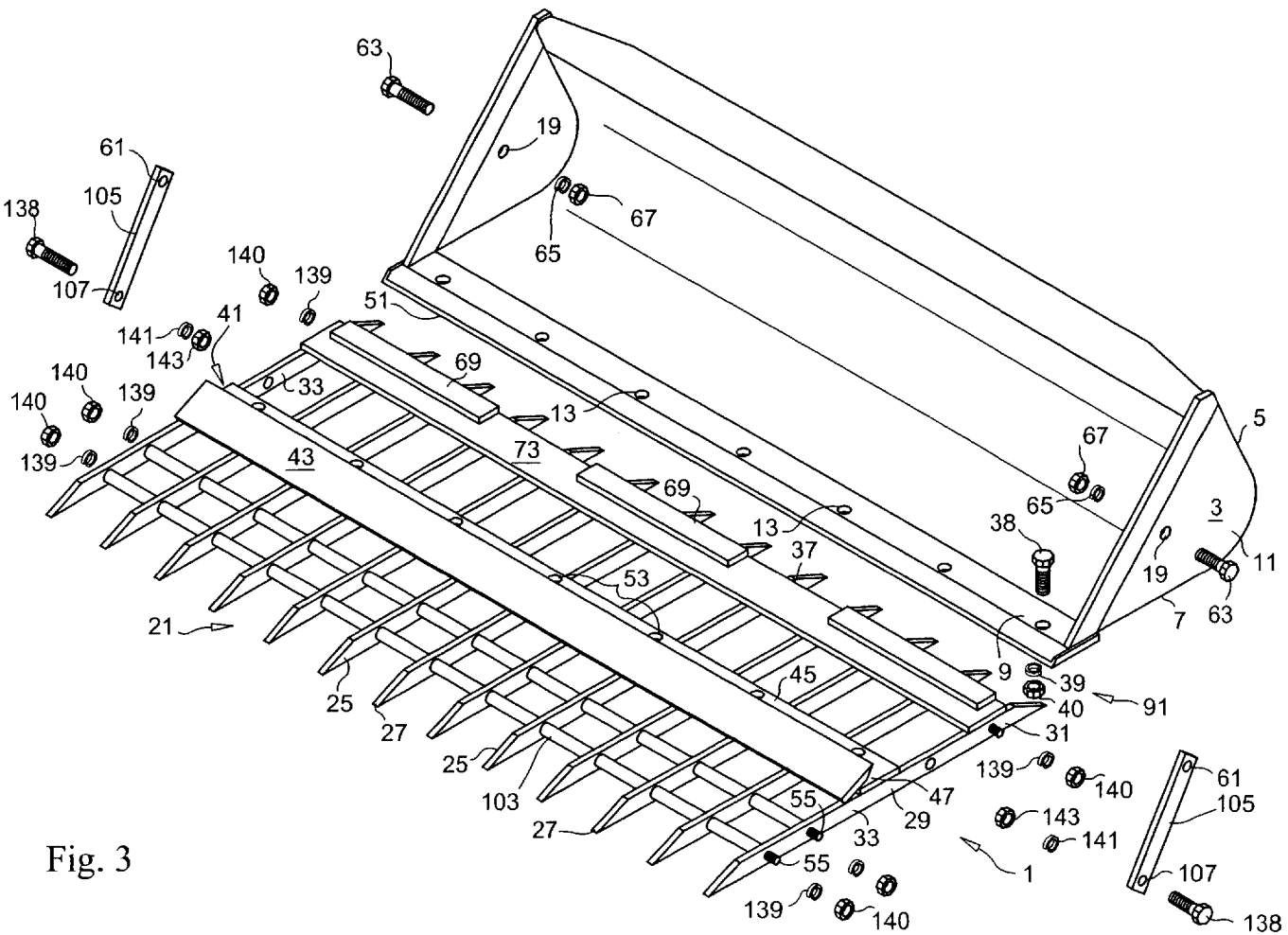
FIG. 3 is an exploded perspective view of another preferred embodiment of the invention.

Referring to FIG. 3, another preferred embodiment of the invention is presented. In this embodiment, three transverse rods 55 are provided. Rods 55 are passed through perforations in teeth 25 and through spacer tubes 103 that are positioned between teeth 25. The ends of rods 55 are threaded and rod lock washers 139 and rod nuts 140 are tightened to secure rods 55 in place.

Figure 4:
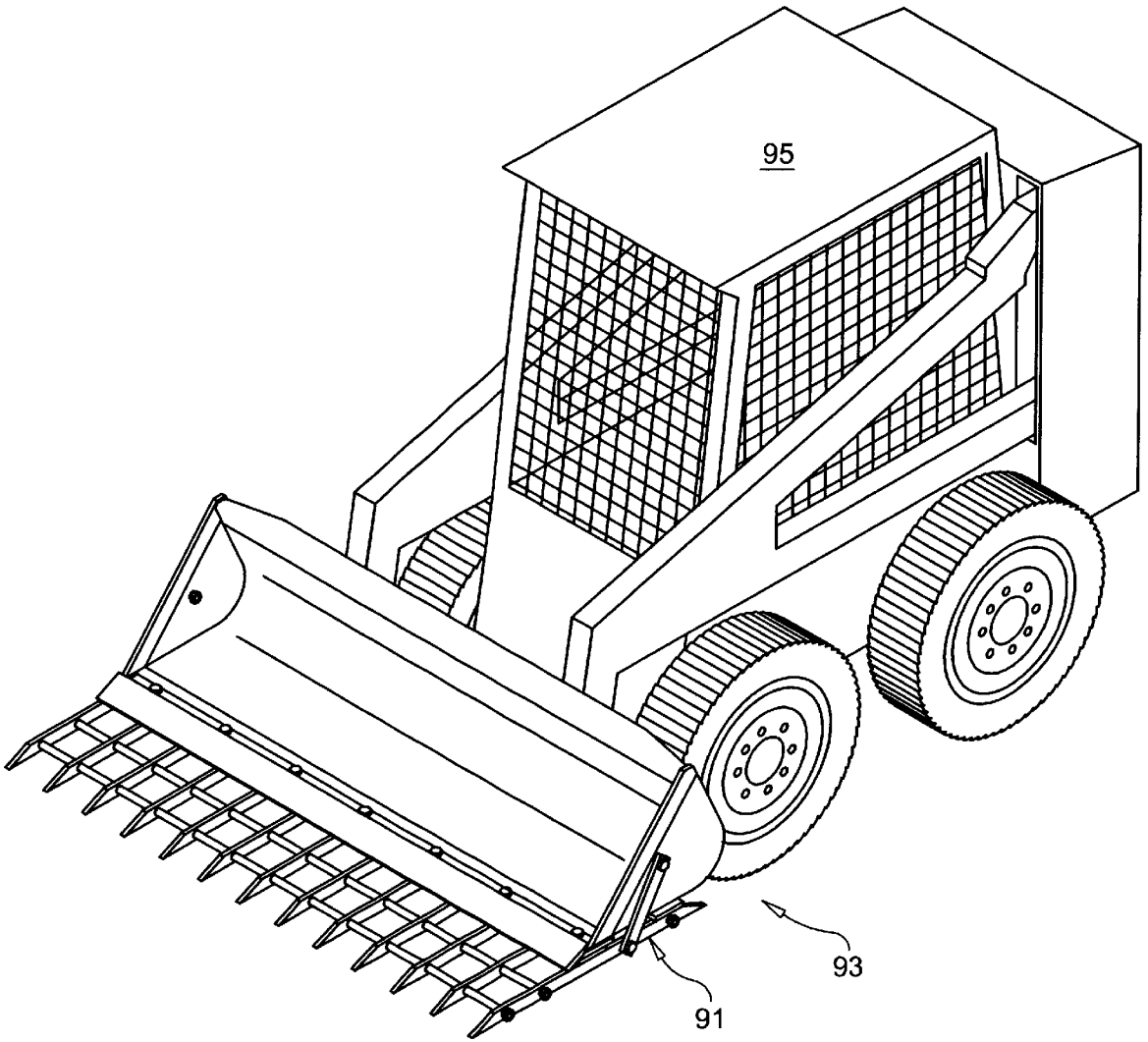
FIG. 4 is another perspective view of another preferred embodiment of the invention.

Moreover, in this embodiment, both front ends 27 and back ends 31 of teeth 25 are pointed. Preferably, ends 27 and 31 of teeth 25 are pointed at an approximately fifty-five degree angle. In this embodiment, attachment 1 is attachable to sides 11 of bucket 3 by means of flat bars 105. Preferably, rake attachment holes 107 at one end of flat bars 105 are bolted to end teeth 33 and bucket attachment holes 61 at the other end of flat bars 105 is bolted to sides 11. Referring to FIG. 4, attachment 1 of FIG. 3 is mounted on front end loader 95.

In use, apparatus 1 is preferably mounted on bucket 3 by placing forward end 51 of bucket 3 into metal pocket 47 formed by the portions of middle transverse member 41 and bolting member 41 to pre-drilled holes in lip 51 of bucket 3. Then, end brackets 23 are connected with bolts to pre-bored holes in sides 11 of bucket 3. Preferably, brackets of three types, short bar brackets 105, long bar bracket 23 and triangular brackets 75, are provided to allow attachment of apparatus I to a wide variety of buckets 3.

The invention is operated by scooping up a mixture of unwanted material into device 1, by shaking bucket 3 and by tilting device 1 backward to move the unwanted material along the rakes 25 until it reaches bucket 3. The dirt falls out of device 1 through the spaces between rakes 25. The invention can be used to level an area by orienting the teeth at an angle to the ground and backing the skip loader up while applying downward pressure on rake 21. The invention also has utility in ditch work, landscaping (e.g., removing grass and sod), cleaning corrals, hauling and distributing gravel on a road surface, leveling a bumpy road and hauling more material than can normally be accommodated in bucket 3. The invention can also be used to clean debris, sticks, weeds, sod, rocks, etc. by tilting the bucket so that the teeth are at a forty-five degree angle and lightly raking the ground. In this operation, the operator backs the loader up, pulling unwanted material into a pile that is then easily picked up.

The structure of attachment 1 is provides great improvements over bucket attachments in the background art. The presence of at least one rod 55 (and, preferably, two rods 55) forward of lip 51 provides transverse support and ensures that material that drops through rake 21 is not excessively long in any dimension. Brackets 23 and/or 75 increase the longitudinal strength of attachment 1 and ensure that material does not fall off the end of rake 21. Bolts 38 securely attach rake 21 to front end 51 along the width of bucket 3. Spacer members 69 ensure that attachment 1 is properly oriented with respect to bottom 7 of bucket 3.

Many variations of the invention will occur to those skilled in the art. Some variations include a separate rake tooth bucket attachment. Other variations call for an integral rake tooth bucket assembly. All such variations are intended to be within the scope and spirit of the invention.

What is claimed is:

1. An attachment for the bucket of a front-end loader, the bucket having a back, a bottom with a forward end having a plurality of transverse attachment holes, and sides, each of the sides having at least one bucket mounting hole, the attachment comprising:

a rake comprising:

a plurality of teeth oriented substantially parallel to one another in a row, each of the teeth having a front end, a middle portion and a back end, and each of the teeth at the ends of the row having a rake mounting hole therein;

a back transverse member to which the back ends of the teeth are attached;

a middle transverse member to which the middle portions of the teeth are attached, the middle transverse member forming a pocket that is configured to receive the forward end of the bucket, the middle transverse member having a plurality of transverse mounting holes therein that align with the transverse attachment holes on the forward end of the bucket for attaching the attachment to the forward end of the bucket by bolting; and at least one transverse rod perforating and supporting the teeth between the points of attachment of the middle transverse member and the front ends; and two end brackets, each of the end brackets having a rake attachment hole at one extremity that aligns with the rake mounting hole on one of the end teeth and a bucket attachment hole at a second extremity that aligns with the at least one bucket mounting hole on the bucket for mounting of the rake on the bucket by bolting.

2. The attachment of claim 1 wherein both the front ends and the back ends of the teeth are pointed.

3. The attachment of claim 1 wherein only the front ends of the teeth are pointed.

4. The attachment of claim 1 further comprising:

a plurality of transverse rods perforating and supporting the teeth between the points of attachment of the middle transverse member and the front ends.

5. The attachment of claim 4 wherein two transverse rods perforate and support the teeth between the points of attachment of the middle transverse member and the front ends.

6. The attachment of claim 4 wherein each of the transverse rods is welded to one of the teeth at each tooth perforation.

7. The attachment of claim 4 wherein each of the transverse rods pass through spacer tubes situated between the teeth that act to space the teeth apart.

8. The attachment of claim 7 wherein each of the transverse rods is threaded on both ends to accept bolts that, when tighten, secure the rod in place.

9. The attachment of claim 1 further comprising:

at least one spacer member that is attached to the top surface of the back transverse member to space the top of the back transverse below the bottom of the bucket, thereby orienting the teeth substantially parallel with the bottom of the bucket.

10. The attachment of claim 1 wherein each bracket is substantially triangular in shape and has a rear-end attachment hole at a third extremity that aligns with a second bucket mounting hole on the bucket for mounting of the rake on the bucket by bolting.

11. The attachment of claim 1 wherein the pocket is formed by attaching an inclined transverse member to the top edge of a lower transverse member.

12. A front end loader accessory comprising:

a bucket; and the attachment of claim 1.

13. An improved front end loader comprising:

the accessory of claim 12; and means to manipulate the accessory.

14. An accessory for a loader, the accessory comprising:

a bucket having a back, sides and a bottom with a forward end;

a rake comprising:

a plurality of teeth oriented substantially parallel to one another in a row, each of the teeth having a front end, a middle portion and a back end, the row having two end teeth;

a back transverse member to which the back ends of the teeth are attached;

a middle transverse member to which the middle portions of the teeth are attached, the middle transverse member forming a pocket that is configured to receive the forward end of the bucket and that is attached to the forward end of the bucket; and at least one transverse rod perforating and supporting the teeth between the points of attachment of middle transverse member and the front ends; and two end brackets, each of the end brackets being operative to connect the rake to one of the sides of the bucket.

15. The accessory of claim 14 wherein the front ends and the back ends of the teeth are pointed.

16. The accessory of claim 14 wherein the end brackets connect the two teeth at the ends of the row to the sides of the bucket.

17. An attachment for a power-operated bucket, the bucket having a back, sides and a bottom with a forward end, the attachment comprising:

a rake comprising:

a plurality of teeth oriented substantially parallel to one another in a row, each of the teeth having a front end, a middle portion and a back end;

a back transverse member to which the back ends of the teeth are attached and which abuts said bottom when said rake is mounted on said bucket;

a middle transverse member to which the middle portions of the teeth are attached, the middle transverse member being attachable to the forward end of the bucket; and at least one transverse rod separating and supporting the teeth between the points of attachment of the middle transverse member and the front ends; and two end brackets for mounting of the rake on the bucket.

18. The attachment of claim 17 wherein both the forward ends and the back ends of the teeth are pointed.

19. The attachment of claim 17 further comprising:

a plurality of transverse rods perforating and supporting the teeth between the points of attachment of the middle transverse member and the front ends and at least one transverse rod supporting the teeth adjacent to the back ends.

20. The attachment of claim 19 wherein the transverse rods pass through spacer tubes situated between the teeth that act to space the teeth apart.

21. The attachment of claim 20 wherein the transverse rods are threaded on both ends to accept bolts that, when tighten, secure the rods and the spacer tubes in place.

22. An attachment for facilitating the separation of a first material from a second material with a power-operated bucket on which the attachment is mounted, the bucket having a back, sides and a bottom with a lip, the attachment comprising:

a rake comprising:

a plurality of teeth oriented substantially in a row, each of the teeth having a front end, a middle portion and a back end;

a back transverse member to which the back ends of the teeth are attached;

a middle transverse member to which the middle portions of the teeth are attached, the middle transverse member being attachable to the lip of the bucket; and at least one transverse rod separating and supporting the teeth, said at least one transverse rod being spaced substantially forward of the lip of the bucket and being operative to prevent the first material from falling between the teeth and to allow the second material to fall between the teeth when said rake is mounted on said bucket; and end brackets for attaching the rake to the sides of the bucket.

* * * * *